US005478162A

United States Patent [19]

Nakayama et al.

[11] Patent Number: 5,478,162

[45] Date of Patent: Dec. 26, 1995

[54] PRINTER

[75] Inventors: Yoshiaki Nakayama; Takeo Kishida; Tatsumi Tsuboki, all of Suwa, Japan

[73] Assignee: Seiko Epson Corporation, Tokyo, Japan

[21] Appl. No.: 347,637

[22] Filed: Dec. 1, 1994

[30] Foreign Application Priority Data

Dec. 3, 1993 [JP] Japan ..... 5-339355

[51] Int. Cl.[6] ..... B41J 13/10

[52] U.S. Cl. ..... 400/605; 400/624; 400/625; 400/692; 346/145; 271/9.09

[58] Field of Search ..... 400/605, 607, 400/607.2, 610, 610.1, 624, 625, 630, 633, 633.1, 633.2, 642, 646, 647, 648, 692, 693; 346/134, 145; 271/9, 145; 347/104, 108

[56] References Cited

U.S. PATENT DOCUMENTS 4,511,904 4/1985 Takahashi ..... 400/624 X
4,729,683 3/1988 Staniszewski ..... 400/624
5,026,184 6/1991 Dürr et al. ..... 400/605
5,158,381 10/1992 Inomata et al. ..... 400/605
5,356,230 10/1994 Ueda et al. ..... 400/605

FOREIGN PATENT DOCUMENTS 0246266 10/1988 Japan ..... 400/624

*Primary Examiner*—Chris A. Bennett
*Attorney, Agent, or Firm*—Stroock & Stroock & Lavan

[57] ABSTRACT

A printer main body is provided having a print section therein for printing and a sheet feed inlet through which paper is supplied to the print section. An automatic sheet feeder is releasably mountable substantially at position for releasably mounting a manual sheet insertion guide so that each can feed paper through the sheet feed inlet. The manual sheet insertion guide is also releasably mountable on the automatic sheet feeder, preferable at an angle at which sheets can be fed through said sheet feed inlet.

12 Claims, 6 Drawing Sheets

PRINTER

BACKGROUND OF THE INVENTION

This invention relates generally to a printer and, more particularly, to a printer capable of attaching an automatic sheet feeder thereto in place of a manual sheet insertion guide by removing the manual sheet insertion guide therefrom.

Printers that allow a manual sheet insertion guide to be removed therefrom and an automatic sheet feeder, which is an optional unit, to be attached thereto in place of the removed manual sheet insertion guide have heretofore been well known. However, these printers of the prior art have generally suffered from the problem that the removed manual sheet insertion guide can be lost when the automatic sheet feeder is attached.

A common method of overcoming this problem comprises a printer which allows the automatic sheet feeder to be attached to the printer while the manual sheet insertion guide is also attached to the printer. However, this design requires that the printer main body have a space for receiving both the manual sheet insertion guide and the automatic sheet feeder and space to provide paper paths for the two paper feed arrangements, which requires a large structure for the printer main body.

Accordingly, it would be advantageous to provide a printer which prevents a removed manual sheet insertion guide from being lost when an automatic sheet feeder is installed in the printer, and allows the use of a single insertion slot for both the automatic sheet feeder and the manual sheet insertion guide, so that the printer can remain a small structure.

SUMMARY OF THE INVENTION

Generally speaking, in accordance with the present invention, a printer having a printer main body and a manual sheet insertion guide is provided. The printer main body has a print section and a sheet feed inlet for supplying a sheet to the print section. The manual sheet insertion guide is attached to the printer main body so as to be removable therefrom and serves to supply a sheet to the sheet feed inlet manually. The printer allows an automatic sheet feeder to be attached to the printer main body in place of the manual sheet insertion guide by removing the manual sheet insertion guide from the printer main body. The automatic sheet feeder is designed to receive and support the manual sheet insertion guide, which is removed from the printer main body, on the automatic sheet feeder after the automatic sheet feeder is attached to the printer body.

Thus, the printer performs a printing operation at the print section on the sheet supplied from the manual sheet insertion guide when the manual sheet insertion guide is attached to the printer main body, and performs a printing operation at the print section on a sheet automatically supplied from the automatic sheet feeder when the manual sheet insertion guide is removed and the automatic sheet feeder is attached to the printer main body instead of the manual sheet insertion guide. When the manual sheet insertion guide is attached to the automatic sheet feeder, the manual sheet insertion guide may constitute a sheet discharge tray supporting a sheet that is discharged after being supplied from the automatic sheet feeder and printed upon. In addition, the manual sheet insertion guide is attached to the automatic sheet feeder at such an angle so as to still be operable to allow the head end of a sheet which is guided by the manual sheet insertion guide to enter into the sheet feed inlet when the sheet is moved toward the sheet feed inlet.

Accordingly, it is an object of the present invention to provide a printer which allows the manual sheet insertion guide which is removed from the printer to be attached to the automatic sheet feeder, when the automatic sheet feeder is attached to the printer, therefore preventing the loss of the manual sheet insertion guide.

Another object of the present invention is to provide a printer in which the removed manual sheet insertion guide is attached to the replacement automatic sheet feeder and not to the printer main body when the replacement automatic sheet feeder is attached to the printer main body, therefore not requiring an additional space for attaching the manual sheet insertion guide to the printer main body at the same time as the automatic sheet feeder is attached, which allows the printer to be smaller.

A further object of the present invention is to provide a printer in which the manual sheet insertion guide which is attached to the automatic sheet feeder serves as a sheet discharge tray that supports a sheet which is discharged after being supplied from the automatic sheet feeder and printed upon, therefore not requiring an independent sheet discharge tray on the printer main body or on the automatic sheet feeder.

Yet another object of the present invention is to provide a printer in which the manual sheet insertion guide is attached to the automatic sheet feeder at such an angle so as to still be operable and to allow the head end of a sheet which is guided by the manual sheet insertion guide to enter into the same sheet feed inlet as is used by the automatic sheet feeder when the sheet is moved toward the sheet feed inlet, thus allowing a sheet of a size different from the sheet supplied from the automatic sheet feeder to be supplied to the printer main body from the manual sheet insertion guide while the automatic sheet feeder is inserted in the printer.

Still other objects and advantages of the invention will in part be obvious and will in part be apparent from the specification and drawings.

The invention accordingly comprises the features of construction, combination of elements, and arrangement of parts, which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
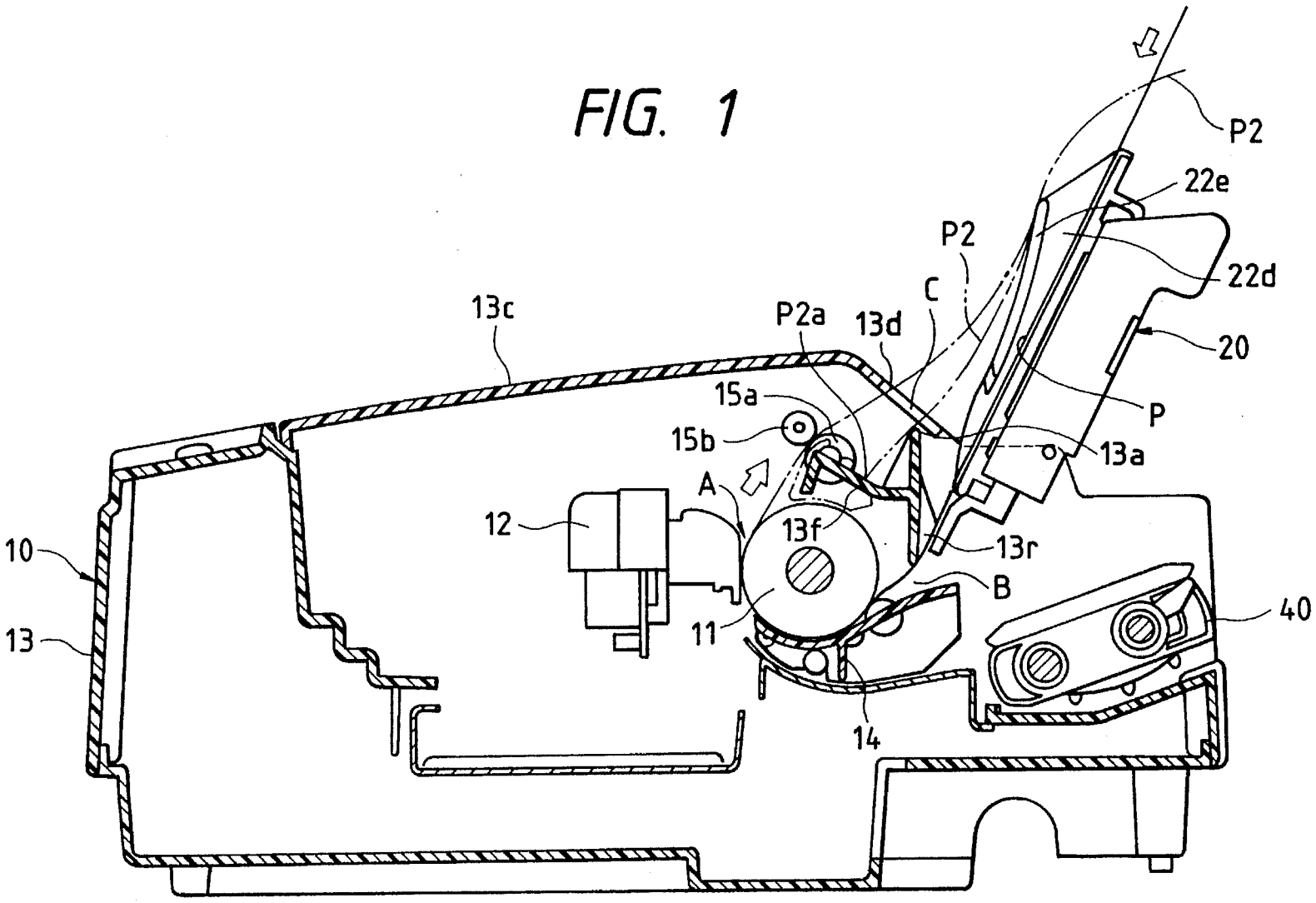
FIG. 1 is a cross-sectional view depicting a printer of a first embodiment of the present invention with a manual sheet insertion guide attached to the printer main body.

Reference is first made to FIG. 1 wherein a printer main body 10 has a print section A and a sheet feed inlet B for supplying a sheet P to print section A. Print section A further includes a platen 11 around which sheet P may extend during printing, and a print head 12 disposed so as to confront platen 11 on printer case 13 with a sheet therebetween. A sheet feed inlet B is formed on the back of a case 13. Sheet P is supplied to sheet feed inlet B and is thereafter forwarded to print section A via a sheet feed path formed of platen 11 and a sheet guide 14. After print head 12 prints material onto sheet P, sheet P is forwarded by sheet discharge rollers 15*a* and 15*b*, and is discharged from a sheet discharge outlet C formed between a rear end edge 13*d* of a cover 13*c* and a rear upper end edge 13*a* of case 13.

Figure 5:
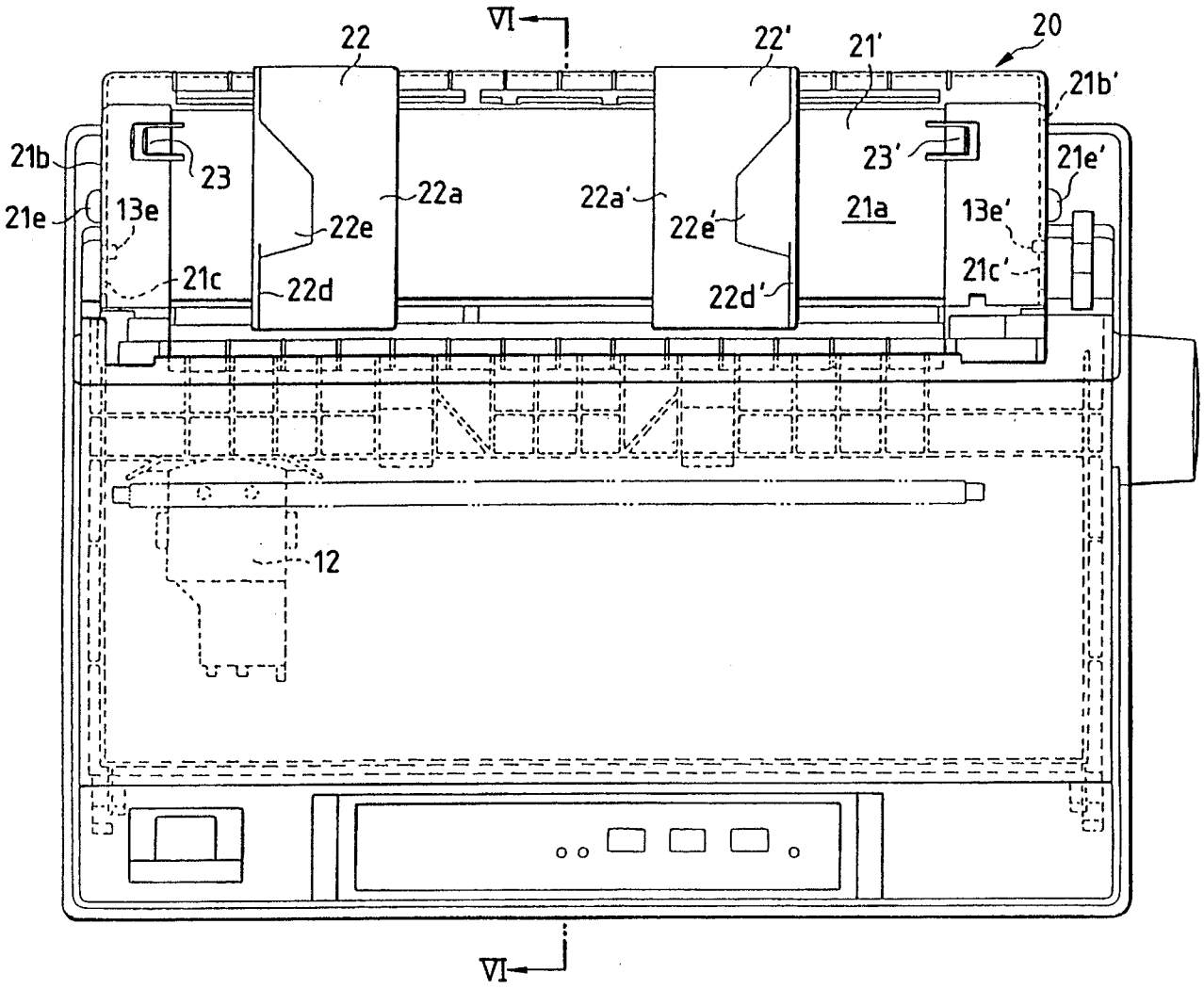
FIG. 5 is a top plan view of the printer of FIG. 4.
Figure 6:
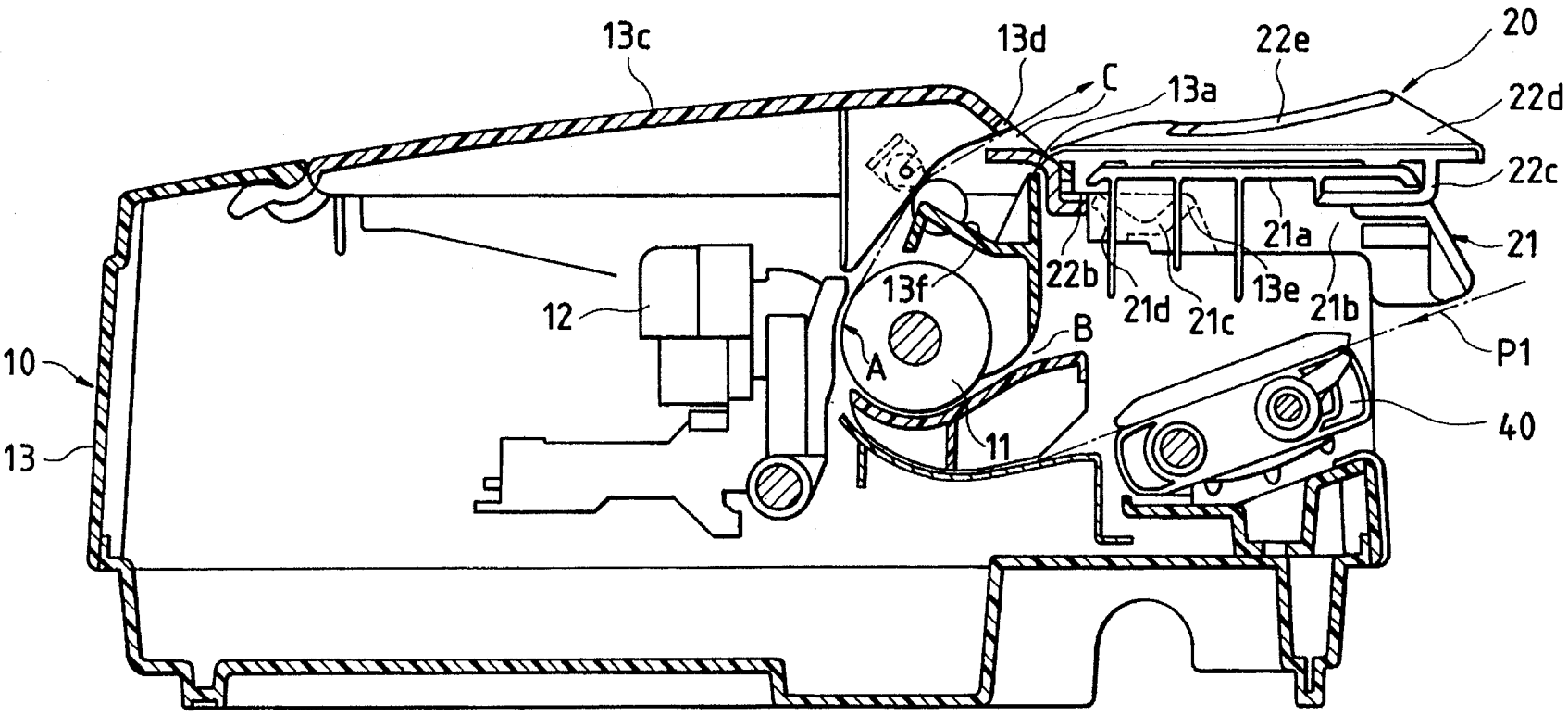
FIG. 6 is a cross-sectional view taken along line VI—VI of FIG. 5.

As shown in FIGS. 5 and 6, a manual sheet insertion guide 20 includes a guide plate 21 and a pair of edge guides 22 and 22' slidably attached to guide plate 21.

Guide plate 21 has a top plate 21*a* and side plates 21*b* and 21*b'*. Manual sheet insertion guide 20 is removably attached to main body 10 by engaging a pair of pins 13*e* and 13*e'* with a pair of substantially V-shaped grooves 21*c* and 21*c'* formed in guide plate 21. Each pin 13*e*, 13*e'* projects inward from opposed sides of the rear upper end of case 13. Each groove 21*c* and 21*c'* is formed on side plates 21*b* and 21*b'*, respectively, and has an opening 21*d* (FIG. 6) into which pins 13*e* and 13*e'* are inserted for positioning in grooves 21*c*, 21*c'*, respectively. As such, manual sheet insertion guide 20 is releasably attached to main body 10.

Pins 13*e* and 13*e'* and grooves 21*c* and 21*c'* are constructed to permit motion relative to each other. Therefore, manual sheet insertion guide 20 is not only slidable with respect to main body 10 in grooves 21*c*, 21*c'*, but is also pivotable about pins 13*e* and 13*e'* when these pins are engaged in the ends of grooves 21*c* and 21*c'*.

As shown in FIG. 1, manual sheet insertion guide 20 is inclined with respect to main body 10 when used as a sheet feed guide. Rib-like projections 13*r* disposed only at both ends on the rear side of a sheet discharge stacker 13*f* are abutted by the distal end of manual sheet insertion guide 20 and thus regulate the pivoting of manual sheet insertion guide 20.

Reference is now made to FIGS. 5 and 6 wherein each edge guide 22 and 22' is depicted as respectively comprising bottom plates 22*a* and 22*a'*, hook portions 22*b* disposed on a bottom front end of each bottom plate 22*a* and 22*a'*, clip portions 22*c* disposed on a bottom rear end of bottom plates 22*a* and 22*a'*, side plates 22*d* and 22*d'* and top plates 22*e* and 22*e'*. Each edge guide 22 and 22' is slidably attached to guide plate 21 by hook portions 22*b* respectively being engaged with the front edge of guide plate 21 and by clip portions 22*c* resiliently biasing the rear portion of guide plate 21.

To supply sheet P, side plates 22*d* and 22*d'* guide the side edges of sheet P, and top plates 22*e* and 22*e'* guide the upper surface of sheet P. In addition, the upper surfaces of side plates 22*d* and 22*d'* as well as top plates 22*e* and 22*e'* are designed to guide the lower surface of sheet P that is to be discharged after being printed upon.

Figure 2:
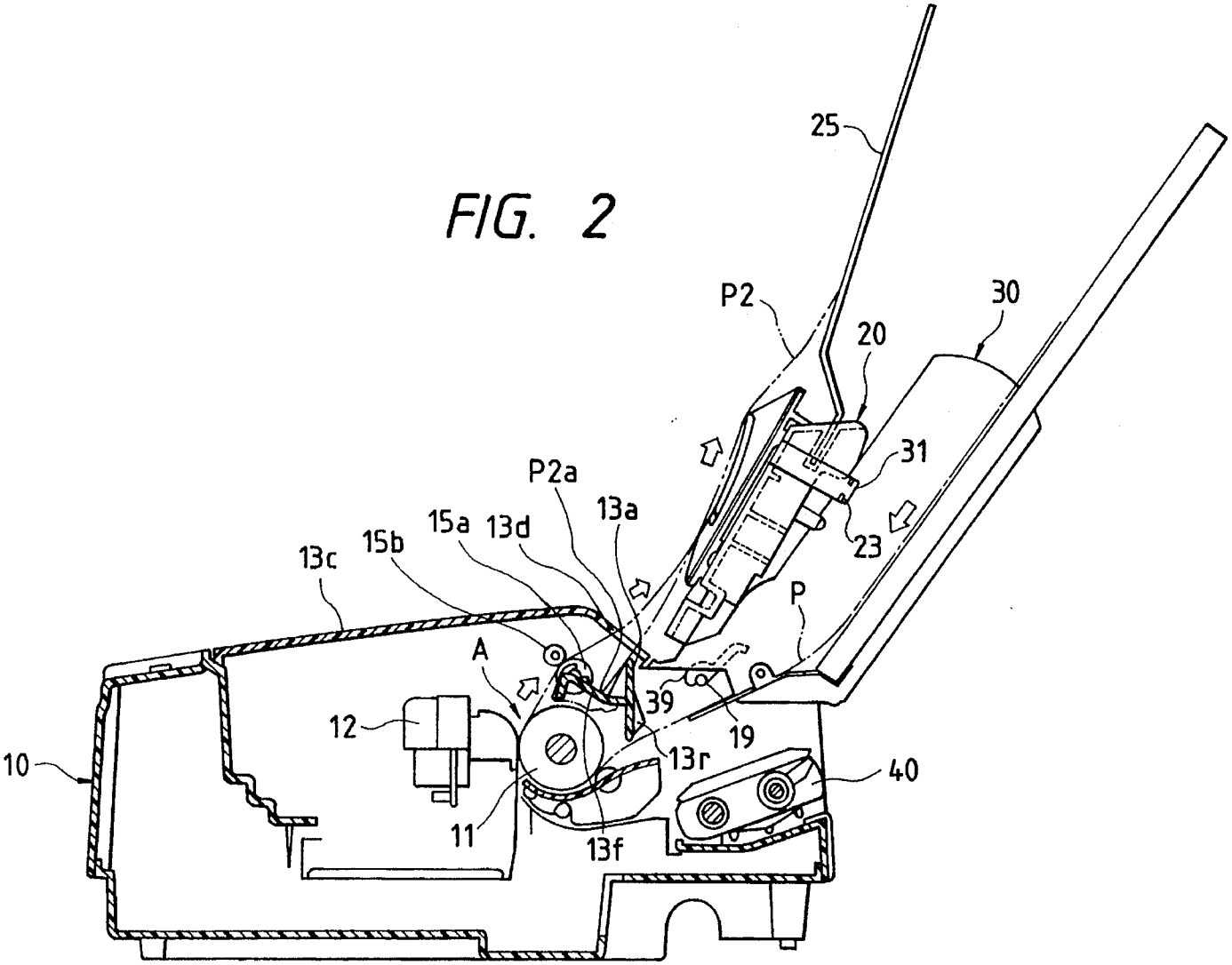
FIG. 2 is a cross-sectional view depicting the printer of FIG. 1 with an automatic sheet feeder attached to the printer main body, and a manual sheet insertion guide attached to the automatic sheet feeder.

Referring next to FIGS. 2 and 5, resilient pawls 23 and 23' and formed integrally on guide plate 21 of manual sheet insertion guide 20. When manual sheet insertion guide 20 is removed from printer main body 10, these resilient pawls 23 and 23' attach manual sheet insertion guide 20 to an automatic sheet feeder 30 by engaging the resilient pawls with recessed portions 31 formed on the side surfaces of automatic sheet feeder 30.

Figure 4:
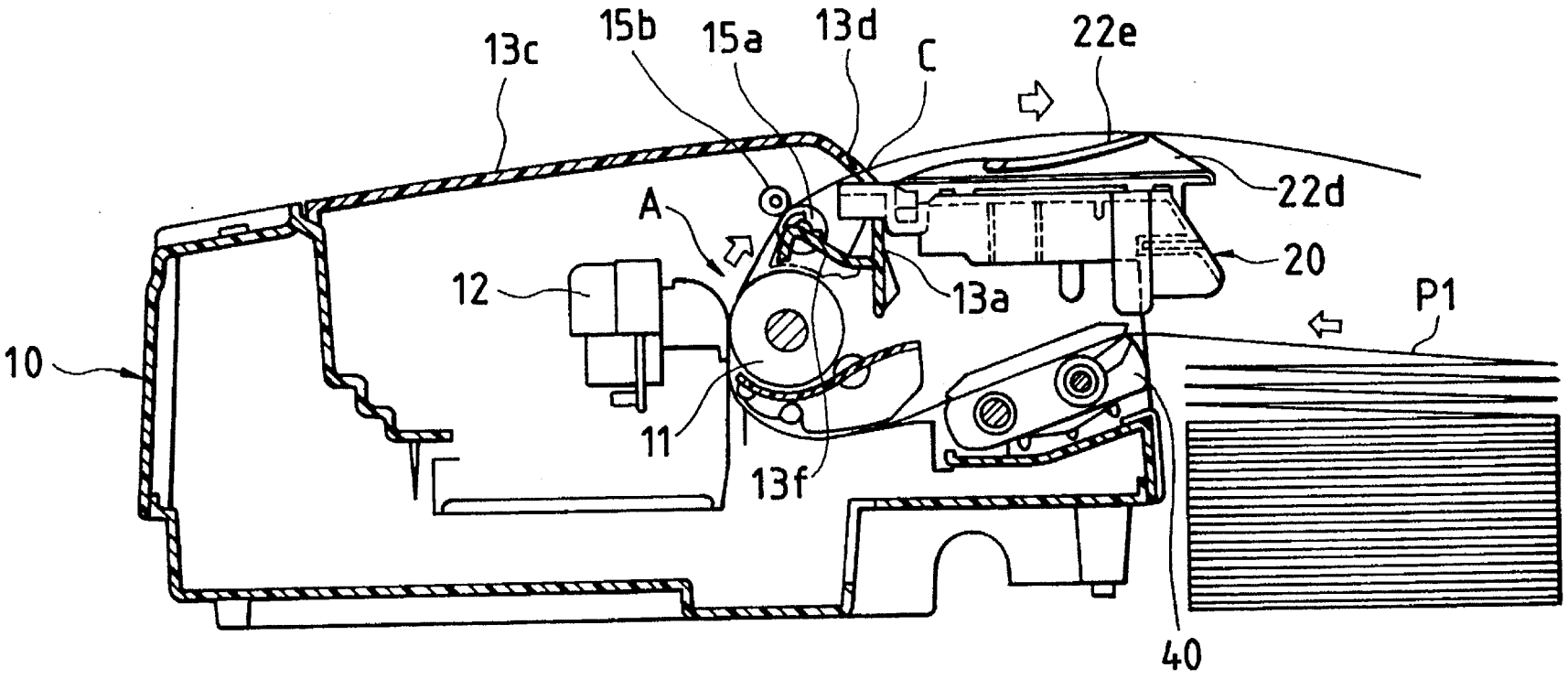
FIG. 4 is a cross-sectional view depicting the printer of FIG. 1 with a continuous sheet being fed to the printer.

For use with continuous paper, a tractor feeder 40 is provided in FIG. 4 for supplying a continuous sheet P1 to printer main body 10.

A mode of use and operation of the thus constructed printer will be described next.

Manual Insertion

As shown in FIG. 1, when manual sheet insertion guide 20 is attached to printer main body 10, sheet P is supplied to sheet feed inlet B from manual sheet insertion guide 20 in order to allow sheet P to be printed on at print section A. Printed sheet P is thereafter discharged from sheet discharge outlet C after being forwarded by sheet discharge rollers 15*a* and 15*b*. A discharged sheet P2 has its back surface supported by top plates 22*e* and 22*e'* of respective edge guides 22 and 22' and a lower end P2*a* of discharged sheet P2 is supported by a stacker 13*f* formed at an upper portion on the back of case 13.

Automatic Sheet Feeding

As shown in FIG. 2, when manual sheet insertion guide 20 is removed from printer main body 10 and automatic sheet feeder 30 is attached to printer main body 10 in its place, sheet P is automatically supplied from automatic sheet feeder 30 in order to allow sheet P to be printed upon at print section A. Automatic sheet feeder 30 is attached to main body 10 by engaging a pair of insertion pawl portions 39 to projected portions 19 formed on the inner surfaces of the side frames of printer main body 10 that support platen 11 and the like (FIG. 2).

When automatic sheet feeder 30 is attached to main body 10, manual sheet insertion guide 20 which has been removed from printer main body 10 can be attached to automatic sheet feeder 30. As a result of this construction, manual sheet insertion guide 20 is retained in contact with the apparatus, and will not be lost. Since manual sheet insertion guide 20 is designed to be attached to automatic sheet feeder 30 and not to printer main body 10 when automatic sheet feeder 30 is attached to printer main body 10, it is no longer necessary to reserve an additional space for attaching manual sheet insertion guide 20 to printer main body 10. Therefore, since only one insertion slot is required, the size of printer main body 10 can be greatly reduced.

As shown in FIG. 2, manual sheet insertion guide 20, which is attached to automatic sheet feeder 30, serves as a sheet discharge tray. This discharge tray supports sheet P2 which is discharged after being supplied from automatic sheet feeder 30 and printed upon. Support rod 25 (FIG. 2) is inserted into a bore in the end of manual sheet insertion guide 20 and help supports sheet P2 after it is discharged.

Figure 3:
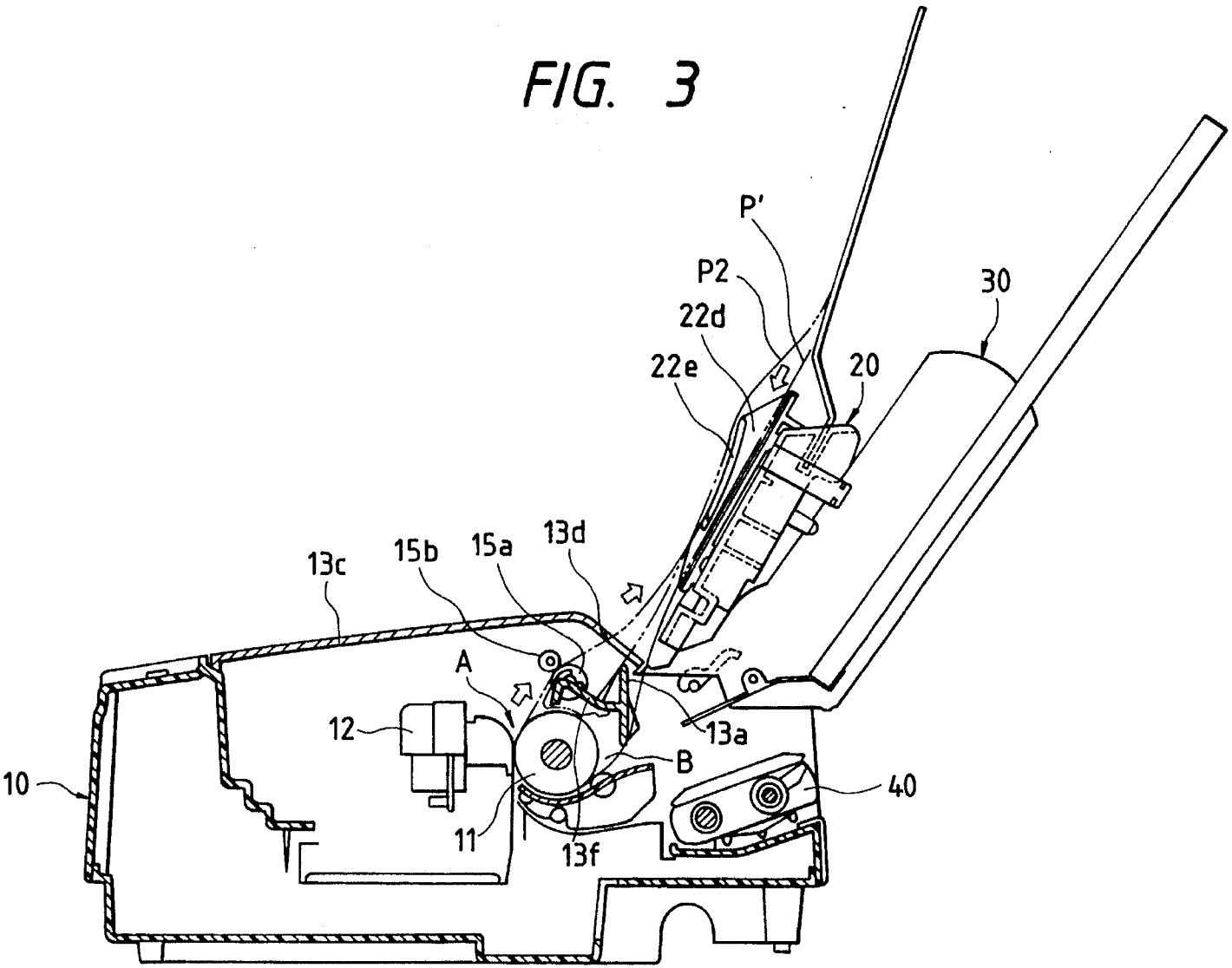
FIG. 3 is a cross-sectional view depicting the printer of FIG. 2 showing the manual feed of a sheet of paper through the printer.

As shown in FIG. 3, manual sheet insertion guide 20 is attached to automatic sheet feeder 30 at such an angle as to still be operable to allow the head end of sheet P which is guided by manual sheet insertion guide 20 to enter sheet feed inlet B when sheet P is moved toward sheet feed inlet B. Therefore, if a sheet P' of a size other than that able to be fed from automatic sheet feeder 30 must be supplied to the printer main body 10, this sheet P' can be supplied from manual sheet insertion guide 20 while automatic sheet feeder 30 is still installed.

Continuous Sheet

As shown in FIG. 4, printing can also be performed on a continuous sheet P1 with manual sheet insertion guide 20 laid flat on printer main body 10. Manual sheet insertion guide 20 is carried on main body 10 with respective grooves 21*c* and 21*c'* engaged with corresponding pins 13*e* and 13*e'* of main body case 13 and with projected pieces 21*e* and 21*e'* projecting from side plates 21*b* and 21*b*' respectively. Manual sheet insertion guide 20 abuts the upper surface of main body case 13, and guides continuous sheet P1 after being discharged from sheet discharge outlet C.

Thus, the printer of the present invention not only prevents the removed manual sheet insertion guide 20 from being lost, but also prevents printer main body 10 from becoming too large.

It will thus be seen that the objects set forth above, and those made apparent from the preceding description, are efficiently attained and, since certain changes may be made in carrying out the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A printer for printing on at least sheets of paper, comprising:

a printer main body formed with a sheet feed inlet for the passage of sheets of paper to the interior of the printer main body;

a print section situated within said printer main body for printing on sheets of paper received from said sheet feed inlet;

an automatic sheet feeder;

first coupling members in said automatic sheet feeder and printer main body permitting releasable mounting of said automatic sheet feeder on said printer main body to automatically supply a plurality of said sheets of paper to said sheet feed inlet;

a manual sheet insertion guide;

second coupling members on said manual sheet insertion guide and said printer main body permitting releasable mounting of said manual sheet insertion guide in place of said automatic sheet feeder onto said printer main body to supply individual sheets of paper to said sheet feed inlet; and third coupling members on said automatic sheet feeder and said manual sheet insertion guide permitting releasable mounting of said manual sheet insertion guide onto said automatic sheet feeder when said automatic sheet feeder is mounted to said printer main body.

2. The printer of claim 1, wherein said manual sheet insertion guide is positioned to act as a sheet discharge tray when mounted on said automatic sheet feeder.

3. The printer of claim 2, further comprising a support rod coupled to said manual sheet insertion guide and positioned to further support discharged sheets.

4. The printer of claim 2, further comprising paper guides mounted in lateral displacement along said manual sheet insertion guide for laterally positioning a sheet of paper to be manually fed, said paper guides including paper guide side plates projecting from said manual sheet insertion guide and paper guide top plates disposed on the distal ends of said paper guide side plates for supporting the discharged sheets.

5. The printer of claim 1, wherein said manual sheet insertion guide is coupled to said automatic sheet feeder at a predetermined angle which allows a sheet to be manually supplied from said manual sheet insertion guide to said sheet feed inlet.

6. The printer of claim 2, wherein said manual sheet insertion guide is coupled to said automatic sheet feeder at a predetermined angle which allows a sheet to be manually supplied from said manual sheet insertion guide to said sheet feed inlet.

7. The printer of claim 1, and including a tractor feed mechanism mounted below said manual sheet insertion guide for feeding continuous pager to said print selection, said second coupling members permit said manual sheet insertion guide to be pivotably displaced on said printer main body between a first manual feed position and a second position where it serves as a discharge tray for said continuous paper.

8. The printer of claim 1, wherein said second coupling members comprise laterally extending pin members in said printer main body and grooves on said manual sheet insertion guide dimensioned to be received in said grooves.

9. The printer of claim 1, wherein said third coupling members comprise a pair of resilient pawl members projecting from said manual sheet insertion guide for operative coupling with said automatic sheet feeder.

10. A method of printing, comprising the steps of:

providing a printer main body having a print section situated within said printer main body for printing on a sheet of paper and formed with a sheet feed inlet providing access for a sheet of paper to said print section;

dismounting a manual sheet insertion guide from a location in said printer main body in registration with said sheet feed inlet at which it permitted manual feed of sheets of paper to said print section;

releasably mounting an automatic sheet feeder to said printer main body substantially at the position previously occupied by said manual sheet insertion guide in registration with said sheet feed inlet to automatically supply a plurality of said sheets of paper to said print section; and releasably mounting said manual sheet insertion guide to said automatic sheet feeder.

11. The method of claim 10, further comprising the step of positioning said manual sheet insertion guide on said automatic sheet feeder so as to serve as a discharge tray for printed paper.

12. The method of claim 10, including the step of positioning said manual sheet insertion guide on said automatic sheet feeder at an angle selected to permit manual feed of sheets of paper through said sheet feed inlet along said manual sheet insertion guide.

* * * * *